US009785084B2

(12) United States Patent
Wada et al.

(10) Patent No.: US 9,785,084 B2
(45) Date of Patent: Oct. 10, 2017

(54) IMAGE FORMING APPARATUS THAT ENSURES SETTING SURFACE POTENTIAL OF PHOTORECEPTOR DRUM WITH SIMPLE CONSTITUTION

(71) Applicant: KYOCERA Document Solutions Inc., Osaka (JP)

(72) Inventors: Minoru Wada, Osaka (JP); Masaru Hatano, Osaka (JP); Masaki Kadota, Osaka (JP); Masahito Ishino, Osaka (JP); Keisuke Isoda, Osaka (JP); Atsushi Ishizaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/277,546

(22) Filed: Sep. 27, 2016

(65) Prior Publication Data

US 2017/0097584 A1 Apr. 6, 2017

(30) Foreign Application Priority Data

Oct. 5, 2015 (JP) ..... 2015-197367

(51) Int. Cl.

| | |
|---|---|
| ***G03G 15/00*** | (2006.01) |
| ***G03G 15/02*** | (2006.01) |
| ***G03G 15/06*** | (2006.01) |
| *G03G 15/01* | (2006.01) |

(52) U.S. Cl.

CPC ..... *G03G 15/0266* (2013.01); *G03G 15/065* (2013.01); *G03G 15/5058* (2013.01); *G03G 15/0189* (2013.01)

(58) Field of Classification Search

CPC ..... G03G 15/0266; G03G 15/065; G03G 15/5058; G03G 15/0189

USPC ..... 399/50, 44, 46, 49

See application file for complete search history.

(56) References Cited

U.S. PATENT DOCUMENTS

| | | | | |
|---|---|---|---|---|
| 2015/0055965 A1* | 2/2015 | Saito | G03G 15/5058 | 399/50 |
| 2015/0117884 A1* | 4/2015 | Sugiyama | G03G 15/065 | 399/44 |
| 2015/0125168 A1* | 5/2015 | Gotoh | G03G 15/5058 | 399/49 |

FOREIGN PATENT DOCUMENTS

JP H 9-106142 A 4/1997

* cited by examiner

*Primary Examiner* — Sophia S Chen

(74) *Attorney, Agent, or Firm* — Stein IP, LLC

(57) ABSTRACT

An image forming apparatus includes an apparatus main body, a photoreceptor drum, a charging apparatus, a developing device, a transfer apparatus, a charging bias applying unit, a developing bias applying unit, a bias adjusting unit, and a print density measurement unit. The bias adjusting unit controls the charging bias applying unit to form a plurality of electric potential areas of electric potentials with different magnitudes. The bias adjusting unit applies a predetermined developing bias corresponding to a target electric potential to the developing roller, so as to form a plurality of toner images by electric potential differences between the developing bias and the plurality of electric potential areas. The bias adjusting unit decides a value of a charging bias corresponding to the target electric potential from measurement results of print densities of the plurality of toner images measured by the print density measurement unit.

15 Claims, 9 Drawing Sheets

IMAGE FORMING APPARATUS THAT ENSURES SETTING SURFACE POTENTIAL OF PHOTORECEPTOR DRUM WITH SIMPLE CONSTITUTION

INCORPORATION BY REFERENCE

This application is based upon, and claims the benefit of priority from, corresponding Japanese Patent Application No. 2015-197367 filed in the Japan Patent Office on Oct. 5, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus employing an electrophotographic method such as a printer and a copier, there has been known an image forming apparatus that includes a photoreceptor drum, a charging apparatus, an exposure apparatus, a developing device, and a transfer apparatus. The charging apparatus uniformly charges a circumference surface of the photoreceptor drum. The exposure apparatus irradiates the photoreceptor drum with exposure light according to image information to form an electrostatic latent image. The developing device supplies the photoreceptor drum with toner to develop the electrostatic latent image into a toner image. The transfer apparatus transfers the toner image from the photoreceptor drum to a sheet.

To obtain good images, it is necessary for a surface potential of the photoreceptor drum in the image forming apparatus to be set to a desired electric potential. Especially, when the charging apparatus includes a charging roller that rotates while contacting a surface of the photoreceptor drum, even if a voltage applied to the charging roller is identical, the surface potential of the photoreceptor drum is likely to vary depending on an environmental variation or a similar factor. With the charging roller to which an ion conducting agent is combined, since a resistance value of the roller is likely to vary depending on the environment or a similar factor, a variation in displacement of the photoreceptor drum is likely to be especially remarkable.

There has been disclosed a typical image forming apparatus that includes a surface electrometer opposed to a circumference surface of a photoreceptor drum. Feeding back a measurement result of an electric potential by the surface electrometer to a voltage applied to a charging apparatus sets a surface potential of the photoreceptor drum to be a desired electric potential.

SUMMARY

An image forming apparatus according to one aspect of the disclosure includes an apparatus main body, a photoreceptor drum, a charging apparatus, a developing device, a transfer apparatus, a charging bias applying unit, a developing bias applying unit, a bias adjusting unit, and a print density measurement unit. The photoreceptor drum has a circumference surface on which an electrostatic latent image including a background portion and an image portion is formed. The photoreceptor drum is rotationally driven in a predetermined rotation direction. The charging apparatus is arranged in contact with or close to the circumference surface of the photoreceptor drum. The charging apparatus charges the circumference surface at a predetermined electric potential. The developing device includes a developing roller disposed opposed to the photoreceptor drum. The developing device supplies the photoreceptor drum with toner to develop the electrostatic latent image into a toner image. The transfer apparatus transfers the toner image from the photoreceptor drum to a sheet or an intermediate transfer belt. The charging bias applying unit applies a predetermined charging bias to the charging apparatus. The developing bias applying unit applies a predetermined developing bias to the developing roller. The bias adjusting unit performs a charging bias adjusting operation. The charging bias adjusting operation adjusts an electric potential at the background portion in the electrostatic latent image on the photoreceptor drum to a predetermined target electric potential. The print density measurement unit measures a print density of the toner image. In the charging bias adjusting operation, the bias adjusting unit controls the charging bias applying unit to form a plurality of electric potential areas of electric potentials with different magnitudes. The electric potential areas are formed on the circumference surface of the photoreceptor drum along the rotation direction. The bias adjusting unit controls the developing bias applying unit to apply the predetermined developing bias corresponding to the target electric potential to the developing roller, so as to form a plurality of toner images by electric potential differences between the developing bias and the plurality of electric potential areas. The bias adjusting unit decides a value of the charging bias corresponding to the target electric potential from measurement results of the print densities of the plurality of toner images measured by the print density measurement unit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
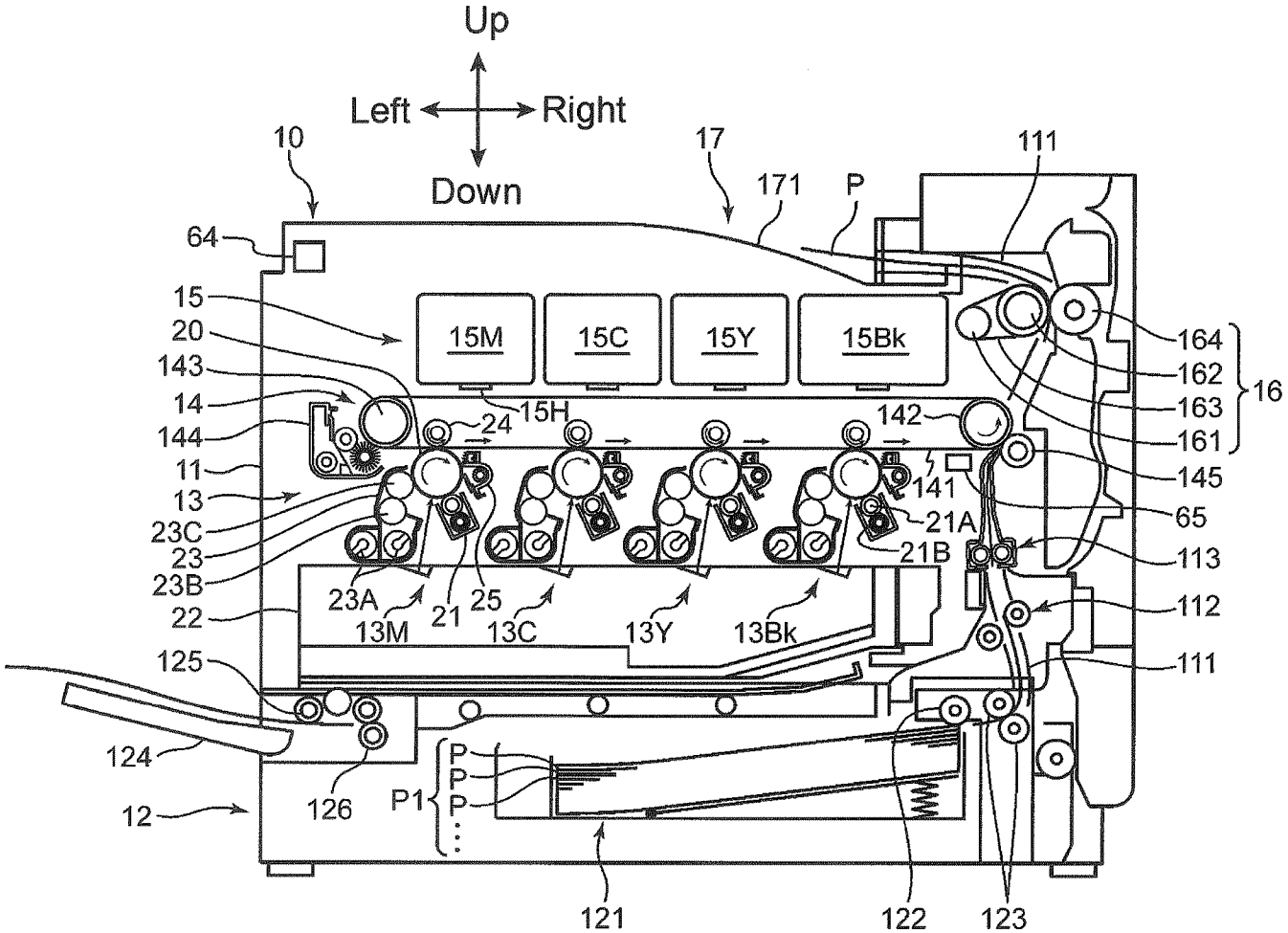
FIG. 1 illustrates a cross section of an internal structure of an image forming apparatus according to an embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an image forming apparatus 10 according to embodiments of the disclosure in detail with reference to the accompanying drawings. This embodiment exemplifies a tandem type color printer as an exemplary image forming apparatus. The image forming apparatus may be devices such as a copier, a facsimile device, and a multi-functional peripheral of these devices.

FIG. 1 illustrates a cross section of an internal structure of the image forming apparatus 10. This image forming apparatus 10 includes an apparatus main body 11 with a box-shaped chassis structure. This apparatus main body 11 internally includes a paper sheet feeder 12, which feeds a sheet P, an image forming unit 13, which forms a toner image to be transferred to the sheet P fed from the paper sheet feeder 12, an intermediate transfer unit 14 on which the toner image is primarily transferred, a secondary transfer roller 145, a toner replenishment unit 15, which replenishes the image forming unit 13 with toner, and a fixing unit 16, which fixes an unfixed toner image formed on the sheet P to the sheet P. Furthermore, at the upper portion of the apparatus main body 11, a paper sheet discharge unit 17 to which the sheet P fixed by the fixing unit 16 is discharged is provided.

At an appropriate position on the top surface of the apparatus main body 11, an operation panel (not illustrated) for an input operation of an output condition or a similar operation to the sheet P is located. This operation panel includes a power key, a touch panel to input the output condition, and various operation keys. Additionally, the apparatus main body 11 internally includes a sheet conveyance path 111, which extends in a vertical direction, at a position right side of the image forming unit 13. The sheet conveyance path 111 includes a conveyance roller pair 112 to feed the sheet at an appropriate position. A registration roller pair 113 is arranged upstream with respect to a secondary transfer nip portion, which will be described later, in the sheet conveyance path 111. The registration roller pair 113 performs skew correction on the sheet and sends out the sheet to the nip portion at a predetermined timing. The sheet conveyance path 111 is a conveyance path that feeds the sheet P from the paper sheet feeder 12 to the paper sheet discharge unit 17 via the image forming unit 13 (the secondary transfer nip portion) and the fixing unit 16.

The paper sheet feeder 12 includes a sheet feed tray 121, a pickup roller 122, and a feed roller pair 123. The sheet feed tray 121 is insertably/removably mounted to a lower position of the apparatus main body 11 to accumulate a sheet bundle P1, which is the plurality of stacked sheets P. The pickup roller 122 feeds out the sheet P on the uppermost surface of the sheet bundle P1 accumulated at the sheet feed tray 121 one by one. The feed roller pair 123 sends out the sheet P fed out by the pickup roller 122 to the sheet conveyance path 111. The paper sheet feeder 12 includes a manual paper feed tray, which is mounted to a left side surface of the apparatus main body 11 illustrated in FIG. 1. The manual paper feed tray includes a bypass tray 124, a pickup roller 125, and a feed roller pair 126. The bypass tray 124 is a tray on which the sheet P is manually placed. When the sheet P is manually fed, as illustrated in FIG. 1, the bypass tray 124 is opened from the side surface of the apparatus main body 11. The pickup roller 125 feeds out the sheet P placed on the bypass tray 124. The feed roller pair 126 sends out the sheet P fed out by the pickup roller 125 to the sheet conveyance path 111.

The image forming unit 13 forms a toner image to be transferred to the sheet P. The image forming unit 13 includes a plurality of image forming units, which form toner images of different colors. As this image forming unit, this embodiment includes a magenta unit 13M, which uses a magenta (M) color developer, a cyan unit 13C, which uses a cyan (C) color developer, a yellow unit 13Y, which uses a yellow (Y) color developer, and a black unit 13Bk, which uses a black (Bk) color developer, sequentially from upstream to downstream in a rotation direction of an intermediate transfer belt 141 (from the left side to the right side shown in FIG. 1). The units 13M, 13C, 13Y, and 13Bk each include a photoreceptor drum 20 (an image carrier), a charging apparatus 21, which is arranged at a peripheral area of the photoreceptor drum 20, a developing device 23, and a cleaning apparatus 25. An exposure apparatus 22 shared by the respective image forming units 13M, 13C, 13Y, and 13Bk is arranged below these image forming unit.

The photoreceptor drum 20 is rotatably driven in a direction of the arrow in FIG. 1 (a predetermined rotation direction) around the axis, and an electrostatic latent image and a toner image are formed on a circumference surface of the photoreceptor drum 20. The electrostatic latent image formed on the photoreceptor drum 20 includes a background portion and an image portion according to image information. A rotation shaft of the photoreceptor drum 20 extends in a front-rear direction (a direction perpendicular to the paper surface of FIG. 1). As this photoreceptor drum 20, a photoreceptor drum using an organic photo conductor (OPC)-based material is applicable. As illustrated in FIG. 1, the plurality of photoreceptor drums 20 corresponding to the respective colors are arranged at predetermined intervals in a lateral direction (a horizontal direction).

The charging apparatus 21 uniformly charges the circumference surface of the photoreceptor drum 20 at a predetermined electric potential. As the charging apparatus 21, a charging apparatus with a contact electrification method can be employed. The charging apparatus 21 includes a charging roller 21A, which contacts the circumference surface of the photoreceptor drum 20 and is arranged and rotationally driven, and a charging cleaning brush 21B to remove toner attached to the charging roller 21A. In another embodiment, the charging roller 21A may be arranged close to the circumference surface of the photoreceptor drum 20. The exposure apparatus 22 includes various optical system devices such as a light source, a polygon mirror, a reflection mirror, and a deflecting mirror. The exposure apparatus 22 irradiates the uniformly charged circumference surface of the photoreceptor drum 20 with light modulated based on image data to form the above-described electrostatic latent image. The cleaning apparatus 25 cleans the circumference surface of the photoreceptor drum 20 after toner image transfer.

The developing device 23 supplies the circumference surface of the photoreceptor drum 20 with toner to develop the electrostatic latent image formed on the photoreceptor drum 20. The developing device 23 is for two-component developer constituted of toner and a carrier. The developing device 23 supplies the toner to the circumference surface of the photoreceptor drum 20 to develop the electrostatic latent image. The developing device 23 includes a developing roller 23C opposed to the photoreceptor drum 20, a magnetic roller 23B, and a pair of screws 23A. As the developing device 23, another constitution including the developing roller 23C may be applied. In this embodiment, the toner has a property that charges to a positive polarity.

The intermediate transfer unit 14 is located at the space between the image forming unit 13 and the toner replenishment unit 15. The intermediate transfer unit 14 includes the intermediate transfer belt 141, a drive roller 142, a driven roller 143, a plurality of primary transfer rollers 24 (transfer rollers), and a belt cleaning apparatus 144.

The intermediate transfer belt 141 is an endless belt-shaped rotator and is suspended across the drive roller 142 and the driven roller 143 such that its circumference surface side is brought into abutment with the circumference surfaces of the respective photoreceptor drums 20. The intermediate transfer belt 141 is circularly driven in one direction along a second direction and carries the toner image transferred from the plurality of photoreceptor drums 20 on its surface. The intermediate transfer belt 141 is a conductive soft belt with a laminated structure formed of a base layer, an elastic layer, and a coat layer.

The drive roller 142 stretches the intermediate transfer belt 141 at a right end side of the intermediate transfer unit 14 and causes the intermediate transfer belt 141 to circularly drive. The drive roller 142 is constituted of a metal roller. The driven roller 143 passively rotates at a left end side of the intermediate transfer unit 14. The driven roller 143 stretches the intermediate transfer belt 141. The driven roller 143 provides the intermediate transfer belt 141 with a tensile force. The belt cleaning apparatus 144 (see FIG. 1), which is located at the proximity of the driven roller 143, removes a remnant toner on the circumference surface of the intermediate transfer belt 141.

The primary transfer roller 24 is located across the intermediate transfer belt 141 and opposed to the photoreceptor drum 20. This forms primary transfer nip portions between the primary transfer rollers 24 and the photoreceptor drums 20 to primarily transfer the toner images, which are on the photoreceptor drums 20, on the intermediate transfer belt 141. As illustrated in FIG. 1, the respective primary transfer rollers 24 are opposed to the photoreceptor drums 20 for the respective colors. The primary transfer roller 24 is a roller extending in the front-rear direction and rotationally driven together with the intermediate transfer belt 141.

The secondary transfer roller 145 is opposed to the drive roller 142 across the intermediate transfer belt 141. The secondary transfer roller 145 is pressed and contacts with the circumference surface of the intermediate transfer belt 141 to form the secondary transfer nip portion. The toner image primarily transferred on the intermediate transfer belt 141 is secondarily transferred on the sheet P supplied from the paper sheet feeder 12 at the secondary transfer nip portion. In this embodiment, the intermediate transfer unit 14 and the secondary transfer roller 145 constitute a transfer apparatus. The transfer apparatus transfers the toner image from the photoreceptor drum 20 to the sheet P.

The toner replenishment unit 15 retains toner used for an image formation. The toner replenishment unit 15 according to the embodiment includes a magenta toner container 15M, a cyan toner container 15C, a yellow toner container 15Y, and a black toner container 15Bk. These toner containers 15M, 15C, 15Y, and 15Bk retain each replenishment toner for the respective colors M, C, Y, and Bk. The toner replenishment unit 15 replenishes the toners for the respective colors to the developing devices 23 for the image forming units 13M, 13C, 13Y, and 13Bk, which correspond to the respective colors M, C, Y, and Bk, from toner discharge ports 15H, which are formed on the bottom surfaces of the containers, via a toner conveying unit (not illustrated).

The fixing unit 16 includes a heating roller 161, which internally includes a heat source, a fixing roller 162, which is located opposed to the heating roller 161, a fixing belt 163, which is stretched between the fixing roller 162 and heating roller 161, and a pressure roller 164, which is opposed to the fixing roller 162 via the fixing belt 163 and forms a fixing nip portion. The sheet P supplied to the fixing unit 16 passes through the fixing nip portion to be heated and pressurized. This fixes the toner image, which has been transferred to the sheet P at the secondary transfer nip portion, to the sheet P.

The paper sheet discharge unit 17 is formed by depressing the top of the apparatus main body 11. The bottom portion of this concave portion forms a sheet discharge tray 171 that receives the discharged sheet P. The sheet P on which the fixing process has been performed is discharged to a sheet discharge tray 171 via the sheet conveyance path 111 running from the upper portion of the fixing unit 16.

Figure 2:
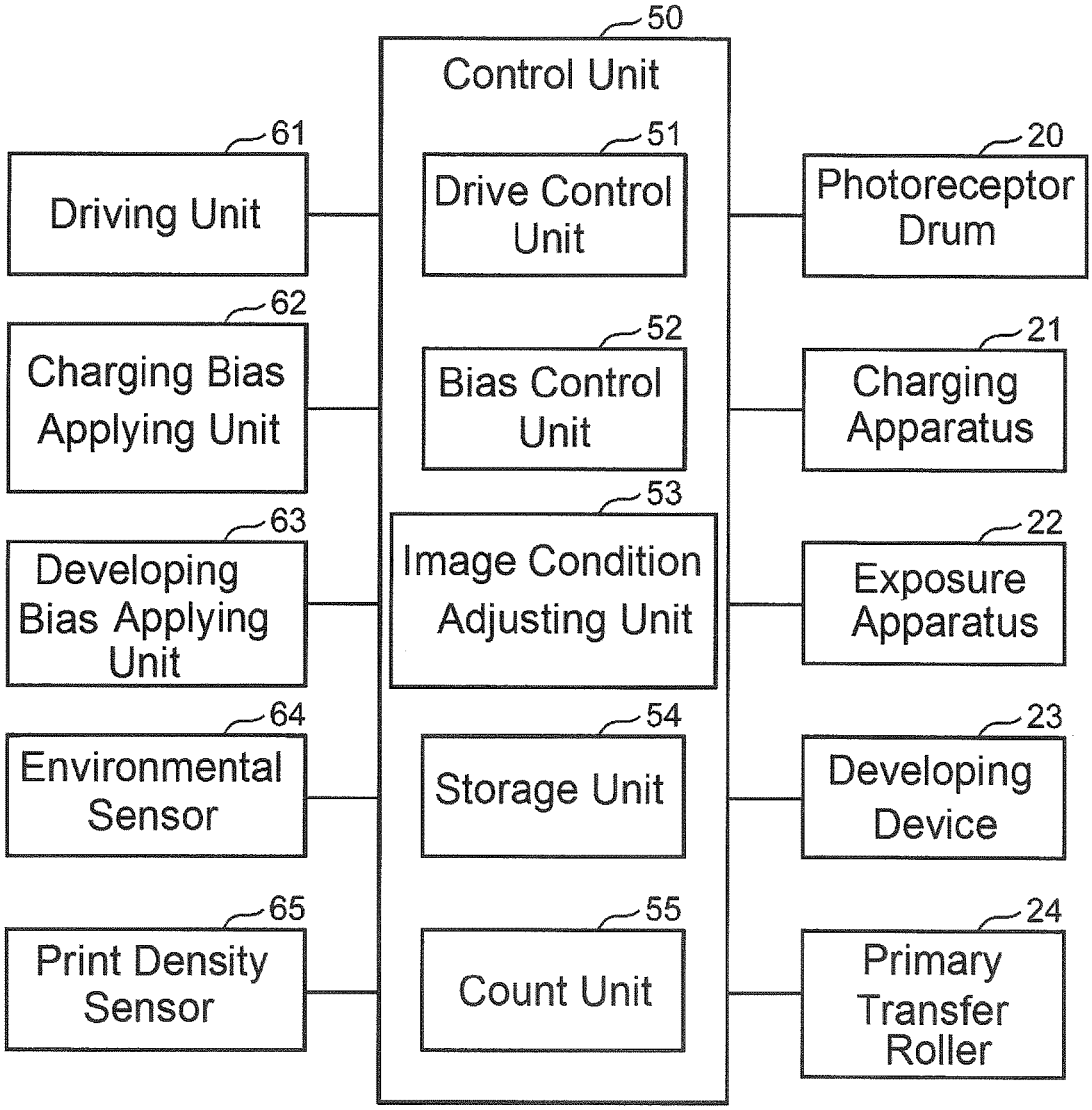
FIG. 2 illustrates an electrical block of a control unit of the image forming apparatus according to the embodiment of the disclosure.

FIG. 2 illustrates an electrical block diagram of a control unit 50 of the image forming apparatus 10 according to the embodiment. The image forming apparatus 10 includes the control unit 50, which integrally controls the respective operations of this image forming apparatus 10. The control unit 50 is constituted of a Central Processing Unit (CPU), a Read Only Memory (ROM), which stores control programs, a Random Access Memory (RAM), which is used as a work area for the CPU, and a similar member. In addition to the above-described photoreceptor drum 20, charging apparatus 21, exposure apparatus 22, developing device 23, and primary transfer roller 24 of the image forming unit 13 and a similar member, to the control unit 50, a driving unit 61, a charging bias applying unit 62, a developing bias applying unit 63, an environmental sensor 64 (an environment detector), a print density sensor 65 (a print density measurement unit), and a similar member are electrically connected.

The driving unit 61 is formed of a gear mechanism that transmits a motor and a torque of the motor. The driving unit 61 rotates the respective members such as the image forming unit 13 and the secondary transfer roller 145 according to a control signal from a drive control unit 51, which will be described later.

The charging bias applying unit 62 is constituted of a DC power supply. Based on a control signal from a bias control unit 52, which will be described later, the charging bias applying unit 62 applies a predetermined charging bias to the charging roller 21A of the charging apparatus 21.

The developing bias applying unit 63 is constituted of a DC power supply and an AC power supply. Based on the control signal from the bias control unit 52, the developing bias applying unit 63 applies a predetermined developing bias to the developing roller 23C and the magnetic roller 23B of the developing device 23.

The environmental sensor 64 (see FIG. 1) is provided with the apparatus main body 11. The environmental sensor 64 detects temperature and humidity inside the apparatus main body 11. In another embodiment, the environmental sensor 64 may detect the temperature and humidity around the apparatus main body 11.

The print density sensor 65 (see FIG. 1) detects an image density of the toner image formed on the intermediate transfer belt 141 and converts the image density into an electric signal. The print density sensor 65 includes a light-emitting element, which emits light on a belt surface of the rotatably driven intermediate transfer belt 141, and a light receiving portion (not illustrated), which receives a reflected light from this belt surface. An image condition adjusting unit 53, which will be described later, refers to information on the image density output from the print density sensor 65, and the information is reflected to a charging bias adjusting operation and a calibration operation, which will be described later.

An execution of the control program stored in the ROM by the CPU causes the control unit 50 to function as the drive control unit 51, the bias control unit 52, the image condition adjusting unit 53, a storage unit 54, and a count unit 55.

The drive control unit 51 controls the driving unit 61 according to an image forming operation by the image forming apparatus 10 and the charging bias adjusting operation and the calibration operation, which will be described later. The drive control unit 51 controls a driving mechanism (not illustrated) as well as the driving unit 61 to drive other driving members in the image forming apparatus 10.

Similarly, the bias control unit 52 controls the charging bias applying unit 62 and the developing bias applying unit 63 according to the image forming operation by the image forming apparatus 10, the charging bias adjusting operation, and the calibration operation. The bias control unit 52 controls a bias applying unit (not illustrated) as well as the charging bias applying unit 62 and the developing bias applying unit 63 to apply a predetermined bias to other members inside the image forming apparatus 10. As one example, the bias control unit 52 applies a primary transfer bias and a secondary transfer bias to the primary transfer roller 24 and the secondary transfer roller 145, respectively.

The image condition adjusting unit 53 performs various image condition adjusting operations in the image forming apparatus 10. This image condition adjusting operation includes the charging bias adjusting operation and the calibration operation. In the charging bias adjusting operation, the image condition adjusting unit 53 adjusts an electric potential at the background portion in the electrostatic latent image on the photoreceptor drum 20 to a predetermined target electric potential.

The storage unit 54 stores various pieces of reference information referred to by the drive control unit 51, the bias control unit 52, and the image condition adjusting unit 53. As one example, the storage unit 54 stores electric potential information referred to in the charging bias adjusting operation.

The count unit 55 counts various pieces of accumulated information in the image forming operation by the image forming apparatus 10 and the image condition adjusting operation. As one example, the count unit 55 counts the number of printed sheets to which the toner images are transferred, a printing interval period of the sheets (a period during which the image forming apparatus 10 is left), the number of accumulated rotations of the photoreceptor drum 20, and an accumulated application period of the charging bias by the charging apparatus 21.

Charging Bias Adjusting Operation

Figure 3:
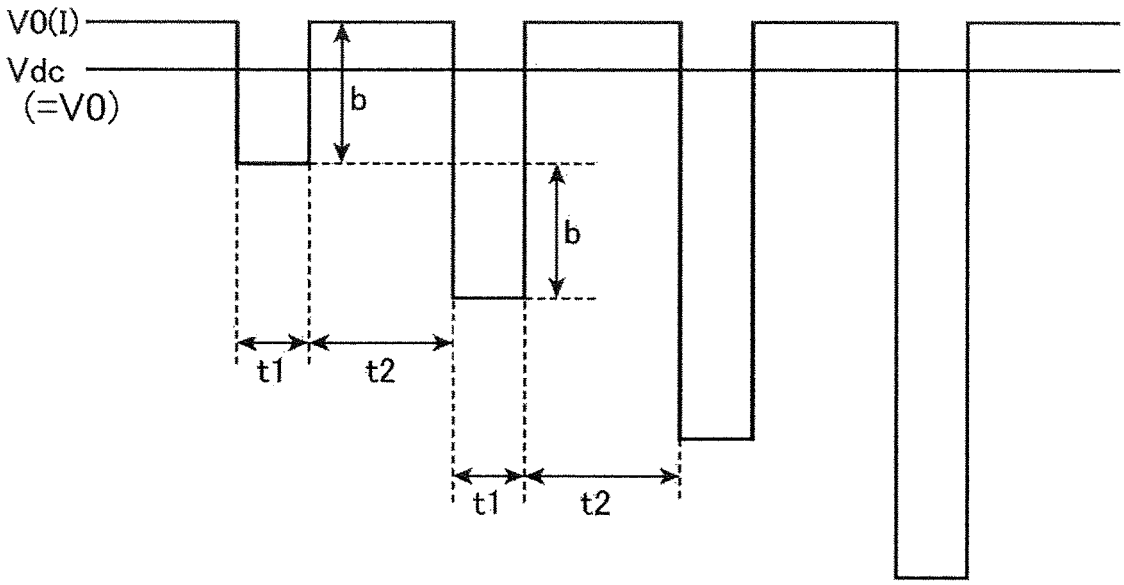
FIG. 3 schematically illustrates an electric potential relationship in a charging bias adjusting operation according to a first embodiment of the disclosure.
Figure 4:
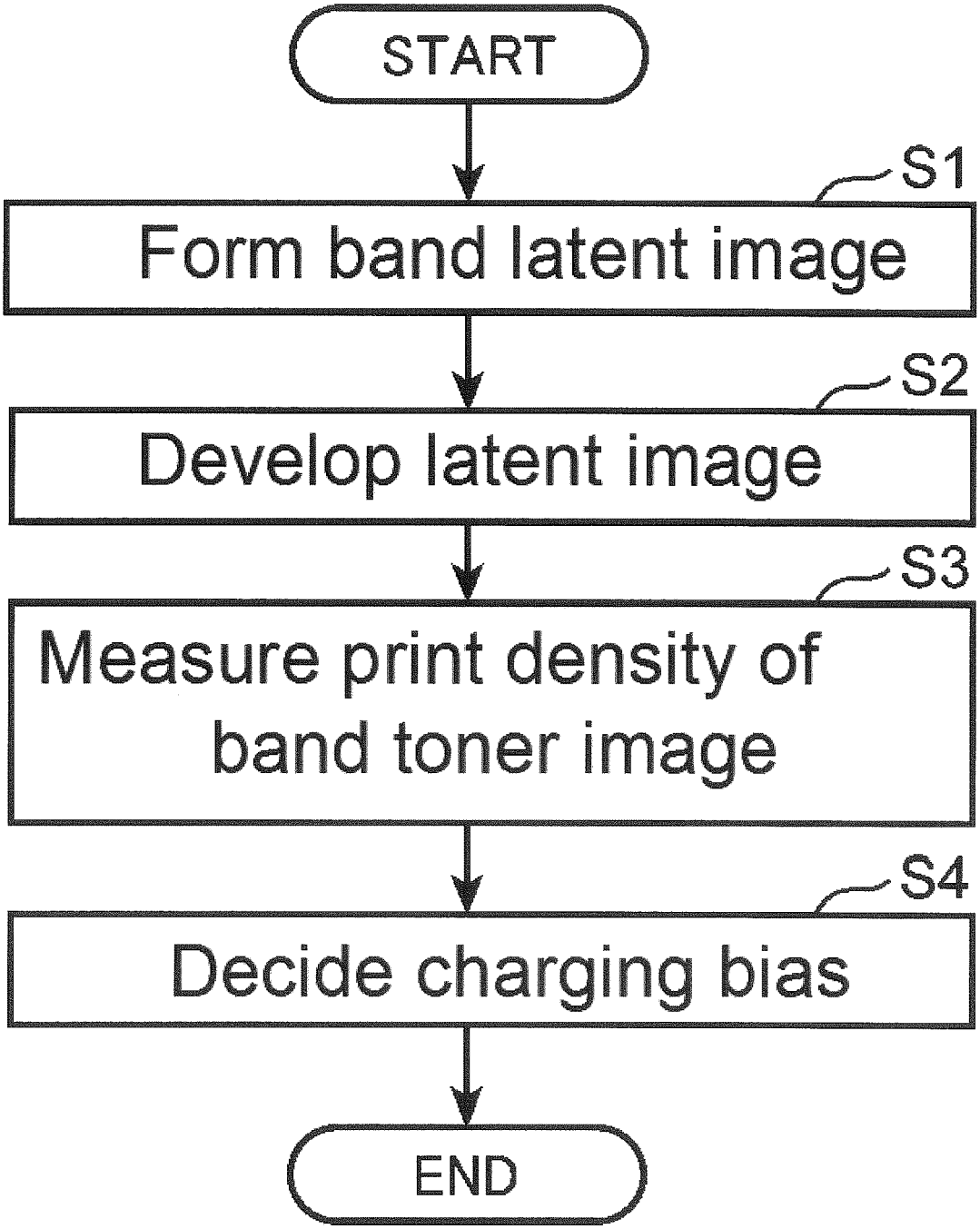
FIG. 4 illustrates the charging bias adjusting operation according to the first embodiment of the disclosure.
Figure 5:
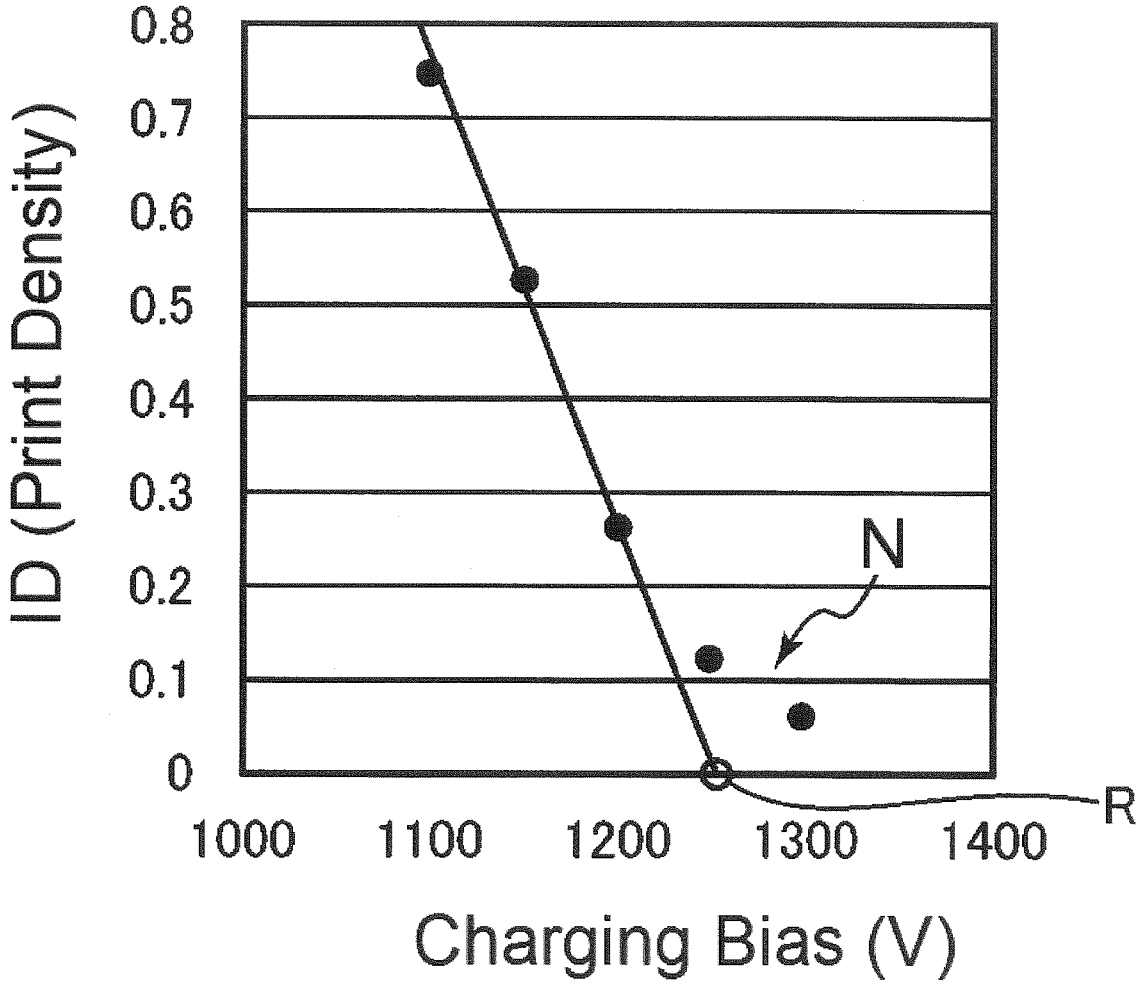
FIG. 5 illustrates a relationship between a print density and a charging bias of a toner image in the charging bias adjusting operation according to the first embodiment of the disclosure.

The following describes the charging bias adjusting operation according to a first embodiment of the disclosure. FIG. 3 schematically illustrates an electric potential relationship between the photoreceptor drum 20 and the developing roller 23C in the charging bias adjusting operation according to the embodiment. FIG. 4 illustrates the charging bias adjusting operation according to this embodiment. FIG. 5 illustrates a relationship between a print density and a charging bias of the toner image in the charging bias adjusting operation according to this embodiment. As described above, this embodiment includes the charging roller 21A, which contacts the circumference surface of the photoreceptor drum 20 and rotates. Especially in this embodiment, an ion conducting agent is combined in the charging roller 21A. Since a resistance value of such ion-conductive charging roller 21A has a property that is likely to change depending on an environmental condition such as a temperature and a humidity, it is difficult to hold the surface potential of the photoreceptor drum 20 constant. In such case, arranging a well-known surface electrometer opposed to the circumference surface of the photoreceptor drum 20 ensures performing a feedback control on the charging bias applied to the charging roller 21A based on a measurement result by the surface electrometer. However, this requires a space to locate an electrometer inside the image forming apparatus and causes a problem of cost increase in the image forming apparatus 10. To solve such problems, this embodiment does not include an electrometer, which measures the surface potential of the photoreceptor drum 20, but the image condition adjusting unit 53 performs the charging bias adjusting operation to accurately set the surface potential of the photoreceptor drum 20 to a target electric potential. This embodiment performs the charging bias adjusting operation in order on the photoreceptor drums 20 for the respective colors. In another embodiment, the charging bias adjusting operation may be concurrently performed on the photoreceptor drums 20 for a plurality of colors.

With reference to FIG. 4, the charging bias adjusting operation includes four steps, a formation of a band image (Step S1), a development of a latent image (Step S2), a measurement of a print density of the band toner image (Step S3), and a decision of a charging bias (Step S4). A timing that the charging bias adjusting operation is performed will be described later in detail.

The execution of the charging bias adjusting operation forms the band image in FIG. 4 by the image condition adjusting unit 53 (Step S1). To form a good image by the image forming apparatus 10, a preset target electric potential at the background portion of the photoreceptor drum 20 is defined as V0 (V). As described above, this embodiment does not directly measure the surface potential of the photoreceptor drum 20 by, for example, the electrometer. Meanwhile, by controlling an input signal input from the bias control unit 52 to the charging bias applying unit 62, it is possible to control a value of the charging bias applied to the charging roller 21A by the charging bias applying unit 62 within a predetermined error range. In view of this, the charging bias adjusting operation derives the value of the charging bias such that the surface potential of the photoreceptor drum 20 becomes V0 (V).

At Step S1, the image condition adjusting unit 53 refers to a charging bias Vref preliminary stored in the storage unit 54 (see FIG. 2). The charging bias Vref is a value preliminary derived experimentally such that the surface potential of the photoreceptor drum 20 becomes V0 (V). FIG. 3 denotes a provisional electric potential at the background portion on the photoreceptor drum 20 corresponding to the charging bias Vref as V0(I). The image condition adjusting unit 53 changes the charging bias into a plurality of levels using this charging bias Vref as a reference to form predetermined latent images (the plurality of electric potential areas). As illustrated in FIG. 3, this embodiment forms four latent images. Especially, the image condition adjusting unit 53 sets the electric potential reduced by b (V) from the charging bias Vref as a first charging bias. Further, the reduction from the first charging bias by regular intervals of b (V) forms the four latent images in total. The respective latent images are applied for a time t1. This embodiment provides a time t2 during which the charging bias Vref is applied between the respective latent images.

This embodiment sets b=50 (V) and t1=30 msec, and sets t2=60 msec. The storage unit 54 (see FIG. 2) preliminary stores these values, and the image condition adjusting unit 53 refers to the values. A peripheral velocity (a system speed) of the photoreceptor drum 20 in the embodiment is set to 166 mm/sec. The preferable range of b is 10 to 100 V and 20 to 50 V is further preferable. Two or more levels of latent images are controllable. However, to improve an accuracy of the charging bias finally derived, providing the levels of three or more is preferable.

At Step S2, the image condition adjusting unit 53 sets a developing bias Vdc applied to the developing roller 23C to the value of the above-described target electric potential V0 and then develops the latent images formed at Step S1. In other words, in FIG. 3, when the developing bias applied to the developing roller 23C during the usual image forming operation (during the development) is set to Vdc (0), the value of Vdc=V0=Vdc (0)+a (V) is applied as the developing bias Vdc. This embodiment sets a=100 V, and the storage unit 54 also preliminary stores this value a. The preferable range of the value a is 50 to 300 V, and 100 to 200 V is further preferable. This embodiment performs a control such that an electric potential difference (V0−Vdc (0)) between the electric potential V0 at the background portion on the photoreceptor drum 20 and the developing bias Vdc (0) during the image forming operation becoming constant. When another embodiment performs the control such that the electric potential V0 at the background portion on the photoreceptor drum 20 during the image forming operation becomes constant, since the value a is not constant, the value V0 may be set to Vdc=V0 as it is at Step S2. As illustrated in FIG. 3, the electric potential differences between the plurality of latent image potentials and the developing bias Vdc forms a plurality of toner images (the band toner images) on the circumference surface of the photoreceptor drum 20 along the rotation direction.

At Step S3, the print densities of the toner images formed at Step S2 is measured. The toner image on the photoreceptor drum 20 is transferred to the intermediate transfer belt 141 at a predetermined primary transfer bias applied to the primary transfer roller 24. The toner image carried on the intermediate transfer belt 141 passes through immediately above the print density sensor 65 in FIG. 1. In this respect, the print density sensor 65 measures the print density of the toner image. The storage unit 54 (see FIG. 2) stores the print density results of the respective toner images measured by the print density sensor 65.

At Step S4, the charging bias according to the target electric potential V0 is decided. The image condition adjusting unit 53 decides the charging bias according to the target electric potential V0 from the plurality of charging biases applied by the charging bias applying unit 62 when the plurality of latent images are formed at Step S1 and the measurement results (ID) of the print densities of the plurality of toner images measured at Step S3. With reference to FIG. 5, when the charging bias is applied to the charging roller 21A by the charging bias applying unit 62 reduces, the electric potential difference between the developing bias Vdc (see FIG. 3) and the surface potential of the photoreceptor drum 20 increases, thereby increasing the print densities of the toner images. In this embodiment, a program is executed by the image condition adjusting unit 53 performs the following operations. That is, the image condition adjusting unit 53 removes two pieces of data located in a region N among the plurality of pieces of data in FIG. 5 and then performs a linear regression on the remaining data. Since the print density data located in this region N has a low print density of the toner image, detection accuracy by the print density sensor 65 is relatively low. Therefore, the print density data is removed during operation. Although a region that the print density sensor 65 can accurately detect the print density of the toner image differs depending on performance of the sensor, the region is preferably in a range of ID=0.1 to 1.0 and further preferably in a range of ID=0.2 to 0.8. The image condition adjusting unit 53 virtually derives an intercept of the horizontal axis of the above-described regression line (see FIG. 5), that is, the value of the charging bias where the print density of the toner image becomes zero (see R in FIG. 5). The image condition adjusting unit 53 decides this derived charging bias as the charging bias corresponding to the target electric potential V0.

The derivation of the charging bias at Step S4 is not limited to the above-described one. Among the plurality of pieces of data in the graph of FIG. 5, a data part with high linearity may be extracted and the regression line may be derived on the basis of this data. Among the plurality of pieces of data in the graph of FIG. 5, after two pieces of data with the highest charging biases and equal to or more than the preset print density (the print density threshold) are selected, the regression line may be derived on the basis of this data. Thus limiting the print density range for linear regression ensures employing the data in the region where the detection accuracy by the print density sensor 65 is high.

As described above, in this embodiment, the image condition adjusting unit 53 controls the charging bias applying unit 62 and forms the plurality of electric potential areas with different electric potential magnitudes on the circumference surface of the photoreceptor drum 20 along the rotation direction in the charging bias adjusting operation. Further, the image condition adjusting unit 53 controls the developing bias applying unit 63 to apply the predetermined developing bias corresponding to the target electric potential of the photoreceptor drum 20 to the developing roller 23C. Consequently, the electric potential difference between the developing bias and the plurality of electric potential areas on the photoreceptor drums 20 forms the plurality of toner images. From the measurement results of the print densities of the plurality of toner images measured by the print density sensor 65, the value of charging bias corresponding to the target electric potential is decided. This ensures setting the surface potential of the photoreceptor drum 20 to the target electric potential with a simple configuration without providing a surface electrometer opposed to the photoreceptor drum 20.

Especially, the image condition adjusting unit 53 controls the developing bias applying unit 63 to apply the developing bias Vdc (=V0=Vdc (0)+a), which is the value identical to the target electric potential V0 for the photoreceptor drum 20, to the developing roller 23C. The image condition adjusting unit 53 derives the value of the charging bias where the print density of the toner image becomes zero from the relationship between the print density measurement results of the plurality of toner images and the plurality of charging biases corresponding to the plurality of electric potential areas. The image condition adjusting unit 53 decides the derived charging bias as the charging bias corresponding to the target electric potential. That is, using the developing bias Vdc, which eases grasping the actual output voltage, as the reference, this embodiment utilizes that the print density of the toner image becomes zero when this developing bias Vdc matches the surface potential V0(I) of the photoreceptor drum 20. Accordingly, the surface potential setting with small error range is achievable with simple configuration.

Further, the image condition adjusting unit 53 causes the charging bias applying unit 62 to apply the charging bias Vref preset corresponding to the target electric potential of the photoreceptor drum 20. The application of the plurality of charging biases such that the absolute values decrease in order from the charging bias Vref forms the plurality of latent images (the electric potential regions) (see FIG. 3). Thus gradually reducing the charging biases stabilizes the surface potential of the photoreceptor drum 20, increasing a correlation between the charging bias and the surface potential of the photoreceptor drum 20. This ensures further highly accurate surface potential setting.

Figure 6A:
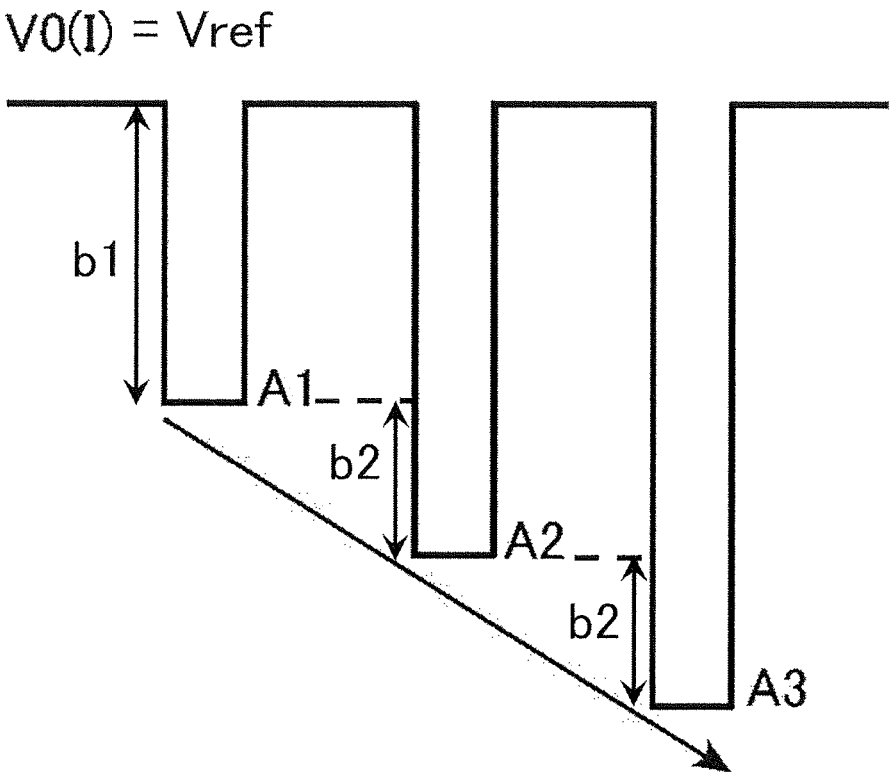
FIG. 6A schematically illustrates a pattern of a plurality of electric potential areas in a charging bias adjusting operation according to a modified embodiment of the disclosure.
Figure 6B:
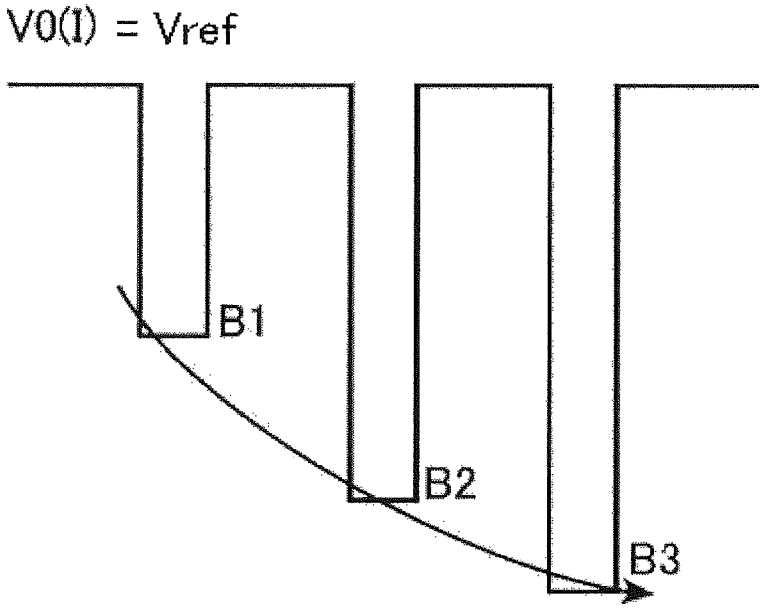
FIG. 6B schematically illustrates a pattern of the plurality of electric potential areas in a charging bias adjusting operation according to a modified embodiment of the disclosure.
Figure 6C:
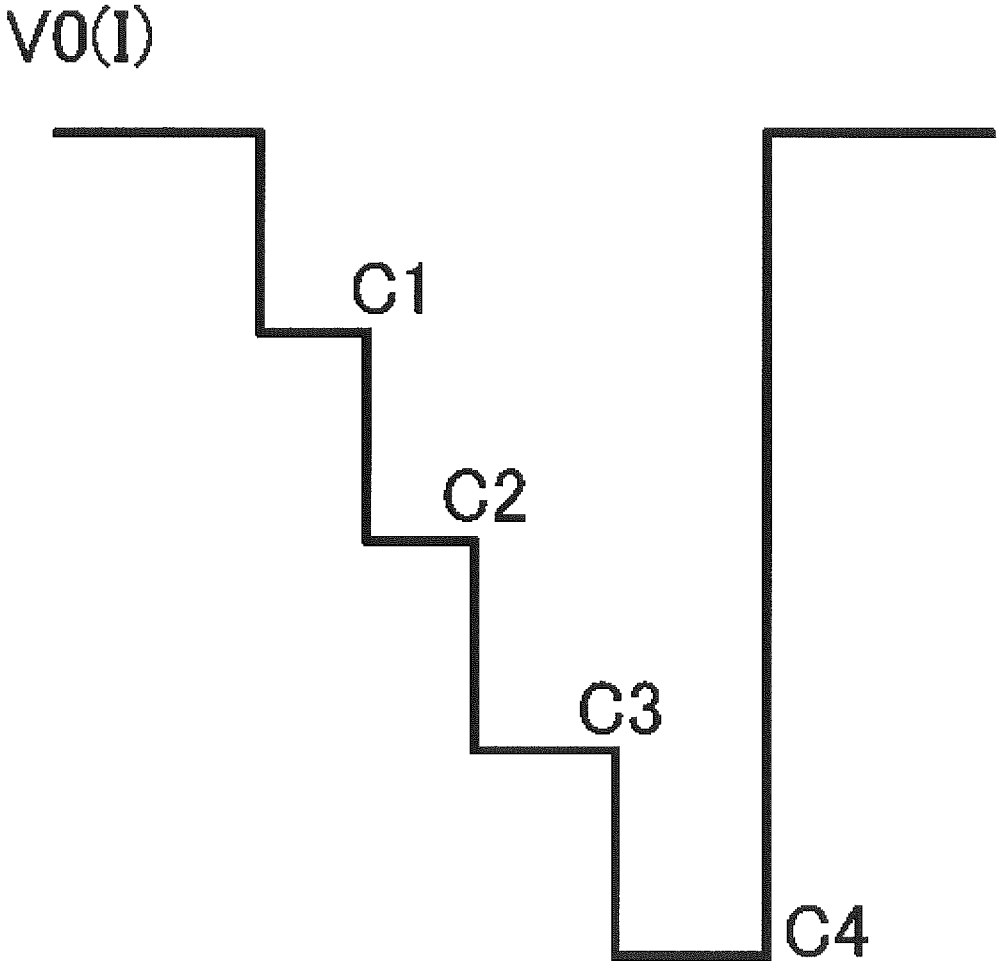
FIG. 6C schematically illustrates a pattern of the plurality of electric potential areas in a charging bias adjusting operation according to a modified embodiment of the disclosure.

At Step S1, a latent image pattern formed on the circumference surface of the photoreceptor drum 20 is not limited to the form illustrated in FIG. 3. It is only necessary that the plurality of electric potential areas with different magnitudes of electric potentials be formed along the rotation direction of the photoreceptor drum 20. FIGS. 6A to 6C schematically illustrate patterns of the plurality of electric potential areas (the latent images) in the charging bias adjusting operation according to modified embodiments of the disclosure. In all cases, the formation of the plurality of latent image potentials from the high electric potential side to the low electric potential side is likely to stabilize the surface potentials of the photoreceptor drums 20, increasing the correlation between the charging biases and the surface potentials of the photoreceptor drums 20. This ensures further highly accurate surface potential setting.

FIG. 6A denotes the electric potential at the background portion on the photoreceptor drum 20 as V0(I). The image condition adjusting unit 53 changes the charging bias into a plurality of levels using the above-described charging bias Vref as the reference to form predetermined latent images. In FIG. 6A, the three latent images are formed. Especially, the image condition adjusting unit 53 sets an electric potential reduced from the charging bias Vref corresponding to the target electric potential V0 by b1 (V) as a first charging bias A1. Further, the image condition adjusting unit 53 reduces the electric potentials by b2 (V) at regular intervals from the first charging bias A1 to apply a second charging bias A2 and a third charging bias A3, thus the three latent images are formed in total. FIG. 6A meets the relationship of b1>b2. In other words, the image condition adjusting unit 53 applies the first charging bias A1 whose absolute value is smaller than Vref (the first tentative charging bias) in the charging bias adjusting operation. After that, the second charging bias A2 whose absolute value is smaller than the first charging bias A1 is applied, thus forming the plurality of electric potential areas. The electric potential difference between Vref and the first charging bias A1 is greater than the electric potential difference between the first charging bias A1 and the second charging bias A2. Thus, largely reducing the charging bias from Vref when the first latent image is formed ensures restraining the formation of a toner band image at a low print density from which the print density fails to be accurately detected by the print density sensor 65. This ensures efficient execution of the charging bias adjusting control.

Meanwhile, in FIG. 6B, a first charging bias B1, a second charging bias B2, and a third charging bias B3 are set such that the intervals between the respective charging biases gradually decrease. As illustrated in FIG. 6A, when the intervals between the respective charging biases are regularly set, it is advantageous in that the calculation of the regression line at Step S4 is simple. However, with the case of regular intervals, the print density of the toner band at the third charging bias A3 becomes dense, this possibly slightly degrades a detection accuracy of print density by the print density sensor 65. Meanwhile, as illustrated in FIG. 6B, gradually reducing the intervals between the charging biases restrains an excessively dense print density of the toner band corresponding to the third charging bias B3.

In FIG. 6C, a first charging bias C1, a second charging bias C2, a third charging bias C3, and a fourth charging bias C4 are continuously applied. Thus, it is also possible to form the latent images continuously without the application of Vref between the respective charging biases. Since this ensures reducing the time t2 in FIG. 3, thereby ensuring substantially reducing the control time in the charging bias adjusting operation. Meanwhile, as illustrated in FIGS. 6A and 6B, to apply Vref between the respective charging biases, since edges of the band latent images become clear, the detection accuracy of the print density by the print density sensor 65 improves.

Figure 7:
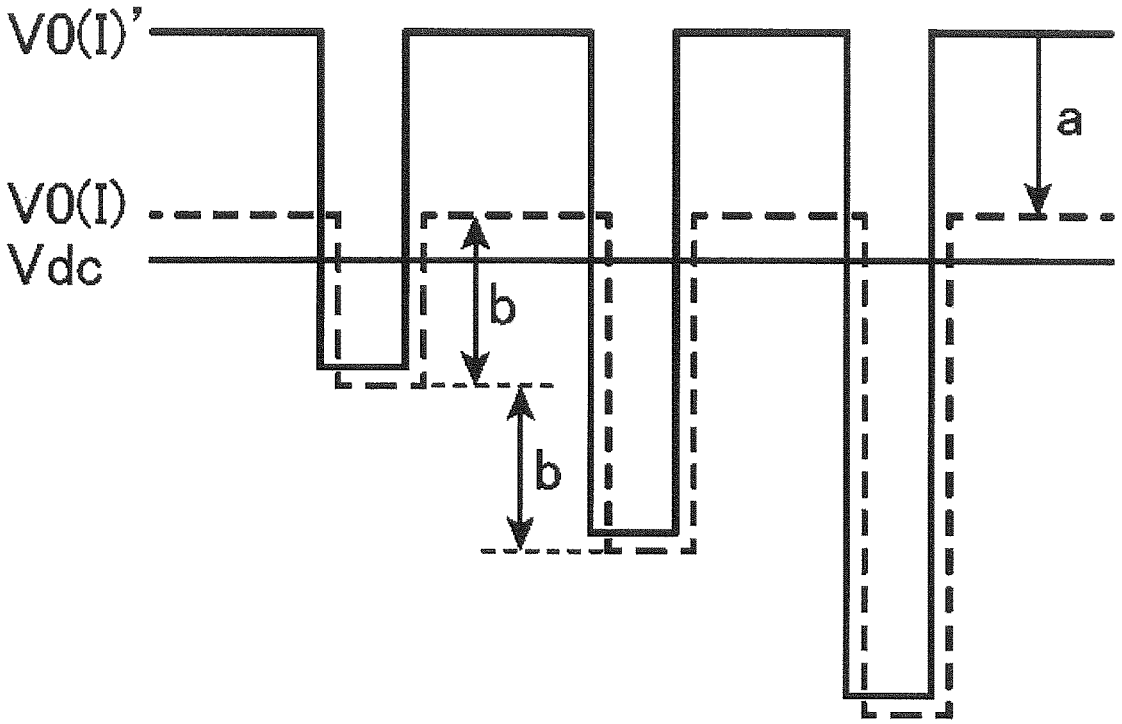
FIG. 7 schematically illustrates an electric potential relationship in the charging bias adjusting operation according to a second embodiment of the disclosure.

The following describes the charging bias adjusting operation according to a second embodiment of the disclosure. FIG. 7 schematically illustrates an electric potential relationship between the photoreceptor drum 20 and the developing roller 23C in the charging bias adjusting operation according to the embodiment. Compared with the above-described first embodiment, this embodiment partially differs in formation of the band latent images at Step S1, development of the latent images at Step S2, and a decision of the charging bias at Step S4. Therefore, the following describes only these differences and omits descriptions on other common control aspects.

With reference to FIG. 7, this embodiment features the surface potential V0(I) of the photoreceptor drum 20 and the value of the developing bias Vdc in the charging bias adjusting operation. For comparison, FIG. 7 denotes the surface potential of the photoreceptor drum 20 in the charging bias adjusting operation of the above-described first embodiment as V0(I)'. Meanwhile, FIG. 7 denotes the surface potential of the photoreceptor drum 20 in the charging bias adjusting operation according to this embodiment as V0(I). Here, the relationship of V0(I)'−V0(I)=a (V) is met. That is, as described in the first embodiment, the image condition adjusting unit 53 causes the charging bias applying unit 62 to apply a value found by subtracting a (V) from the preset charging bias Vref (the first tentative charging bias) as the charging bias Vref (a second tentative charging bias) of the embodiment (Step S1). That is, the charging bias Vref according to the embodiment aims to form the surface potential smaller by a (V) from the original target electric potential V0 on the photoreceptor drum 20. Then, as illustrated in FIG. 7, the charging biases are sequentially decreased from Vref, thus forming the plurality of latent images.

Further, at Step S2 (see FIG. 4), the image condition adjusting unit 53 applies the developing bias Vdc to the developing roller 23C. At this time, this embodiment sets Vdc=V0−a (V). In the charging bias adjusting operation, as long as the developing bias Vdc, which is applied to the developing roller 23C, is set to the value of the target electric potential V0 for the photoreceptor drum 20 like the above-described first embodiment, simplified and highly accurate control is possible. Meanwhile, in the usual image forming operation, the developing bias Vdc at development is less likely to be set high to the extent of the target surface potential V0 for the photoreceptor drum 20. Accordingly, the target electric potential V0 sometimes exceeds the control range of the developing bias Vdc during the usual image forming operation. As will be described later, depending on a usage environment, the target electric potential for the photoreceptor drum 20 needs to be set to V0 higher than usual; therefore, the developing bias Vdc is sometimes difficult to be set to a value identical to V0. In this case, when the control range of the developing bias Vdc is attempted to be extended, this leads to a cost increase of a high-voltage circuit board of the developing bias applying unit 63. Meanwhile, in this embodiment, with the developing bias Vdc set lower than the surface potential V0 for the photoreceptor drum by a (V), the latent images are developed. Accordingly, the cost increase of the developing bias applying unit 63 is restrained.

Meanwhile, with the large electric potential difference between the developing bias Vdc and the surface potential V0(I) on the photoreceptor drum 20 by the charging bias Vref, the use of the two-component developer to the developing device 23 is likely to move the carrier to the photoreceptor drum 20 side during the charging bias adjusting operation. This possibly causes an image defect in the image formation after the adjustment operation. In view of this, it is preferable that the reference charging bias Vref is also set low according to the value of the developing bias Vdc. In this embodiment, as described above, the bias lower than the charging bias Vref of the first embodiment by a (V) is set as Vref.

Compared with the first embodiment, this embodiment describes the aspect where the differential electrical potential b (V) when the charging bias Vref is reduced (the second differential electrical potential) (V0(I)'−V0(I)) is set to be the value identical to the differential electrical potential a (V) when the developing bias Vdc is reduced from the target surface potential V0 for the photoreceptor drum 20 (the first differential electrical potential) (b=a). However, in other embodiments, both constant values may be different values. Like this embodiment, when both constant values are set to be identical, the relationship between the developing bias Vdc and the surface potential V0 for the photoreceptor drum 20 in the charging bias adjusting operation has a relative relationship identical to one in the usual development (in the image formation). Accordingly, this is preferable also in terms of carrier development, toner fogging, and further tone reproducibility.

After performing Step S3 similar to the first embodiment, the image condition adjusting unit 53 decides the charging bias at Step S4 (see FIG. 4). Then, similar to the first embodiment, the image condition adjusting unit 53 removes two pieces of data located in the region N among the plurality of pieces of data in FIG. 5 and then performs the linear regression on the remaining data. The image condition adjusting unit 53 virtually leads the intercept of the horizontal axis of the above-described regression line (see FIG. 5), that is, the value of the charging bias where the print density of the toner image becomes zero (see R in FIG. 5). As described above, this embodiment sets the developing bias Vdc=V0−a (V). Accordingly, the charging bias with the value identical to the developing bias Vdc in the charging bias adjusting operation becomes a value lower than the target electric potential V0 by a (V). In view of this, in this embodiment, the image condition adjusting unit 53 decides the value found by adding a (V) to the value of the charging bias where the print density of toner image becomes zero as the value of the charging bias corresponding to the target electric potential V0. Consequently, even if the developing bias Vdc in the charging bias control operation is set low to restrain the cost increase in the developing bias applying unit 63, this embodiment ensures accurately leading the charging bias corresponding to the target electric potential V0 for the photoreceptor drum 20.

As described above, in this embodiment, the image condition adjusting unit 53 controls the developing bias applying unit 63 to apply the developing bias Vdc (V0−a), which has the value smaller than the target electric potential V0 for the photoreceptor drum 20 by a (V), the preset value (the first differential electrical potential), to the developing roller 23C. Further, the image condition adjusting unit 53 derives the value of the charging bias where the print density of the toner image becomes zero from the relationship between the print density measurement results of the plurality of toner images and the plurality of charging biases corresponding to the plurality of electric potential areas. Then, the image condition adjusting unit 53 decides the value found by adding a (V) to this derived charging bias as the charging bias corresponding to the target electric potential for the photoreceptor drum 20.

Execution Timing of Charging Bias Adjusting Operation

The following describes the execution timing of the charging bias adjusting operation according to the above-described first and second embodiments (hereinafter referred to as the embodiments). In the image forming apparatus 10, when the surface potential of the photoreceptor drum 20 varies, an image defect such as a print density variation occurs. Accordingly, it is preferable to perform the charging bias adjusting operation under conditions where the surface potential of the photoreceptor drum 20 is likely to vary from the target electric potential V0. The following describes the preferable conditions.

First, it is preferable that the charging bias adjusting operation is performed when the image forming apparatus 10 is left for a long time after a termination of the previous image forming operation. In this case, temperature and humidity environments inside and outside the image forming apparatus 10 or a similar factor may vary or the property of the charging roller 21A of the charging apparatus 21 may change. In the embodiments, the image forming apparatus 10 includes the count unit 55 (see FIG. 2). The count unit 55 operates a difference between an end time of the previous image forming operation and a request time of the next image forming operation. In other words, the count unit 55 counts a printing interval period between sheets. When the printing interval period by the count unit 55 exceeds a preset threshold stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the unused image forming apparatus 10 is left over a long period of time.

Secondary, if the temperature and humidity inside and outside the machine of the image forming apparatus 10 largely change, the charging bias adjusting operation is preferably performed. In this case, due to the variation of the temperature and humidity environments, the property of the charging roller 21A of the charging apparatus 21 may change. In the embodiments, the image forming apparatus 10 includes the environmental sensor 64 (see FIG. 2). Accordingly, if the temperature or the humidity detected by the environmental sensor 64 exceeds the preset threshold, which is stored in the storage unit 54, it is only necessary for the image condition adjusting unit 53 to perform the charging bias adjusting operation prior to the next image forming operation. This prevents the image defect in association with the variation of the surface potential of the photoreceptor drum 20 even if the temperature and humidity inside and outside the machine of the image forming apparatus 10 largely change. A detection timing of the temperature and humidity by the environmental sensor 64 may be performed at constant time intervals. If the temperature and humidity when the previous charging bias adjusting operation has been performed are stored in the storage unit 54 and amounts of variation from these stored temperature and humidity are large, whether to perform the charging bias adjusting operation or not may be determined.

Thirdly, if the number of printed sheets printed within a predetermined period exceeds the preset threshold stored in the storage unit 54, the image condition adjusting unit 53 may perform the charging bias adjusting operation. Continuous executions of the image forming operation over a long time are likely to vary the surface potential of the photoreceptor drum 20 due to a temperature rise of the photoreceptor drum 20, the property change of the charging roller 21A, or a similar cause. Accordingly, with the large number of printed sheets within the predetermined time, accurately adjusting the surface potential V0 of the photoreceptor drum 20 prevents the image defect.

Figure 8:
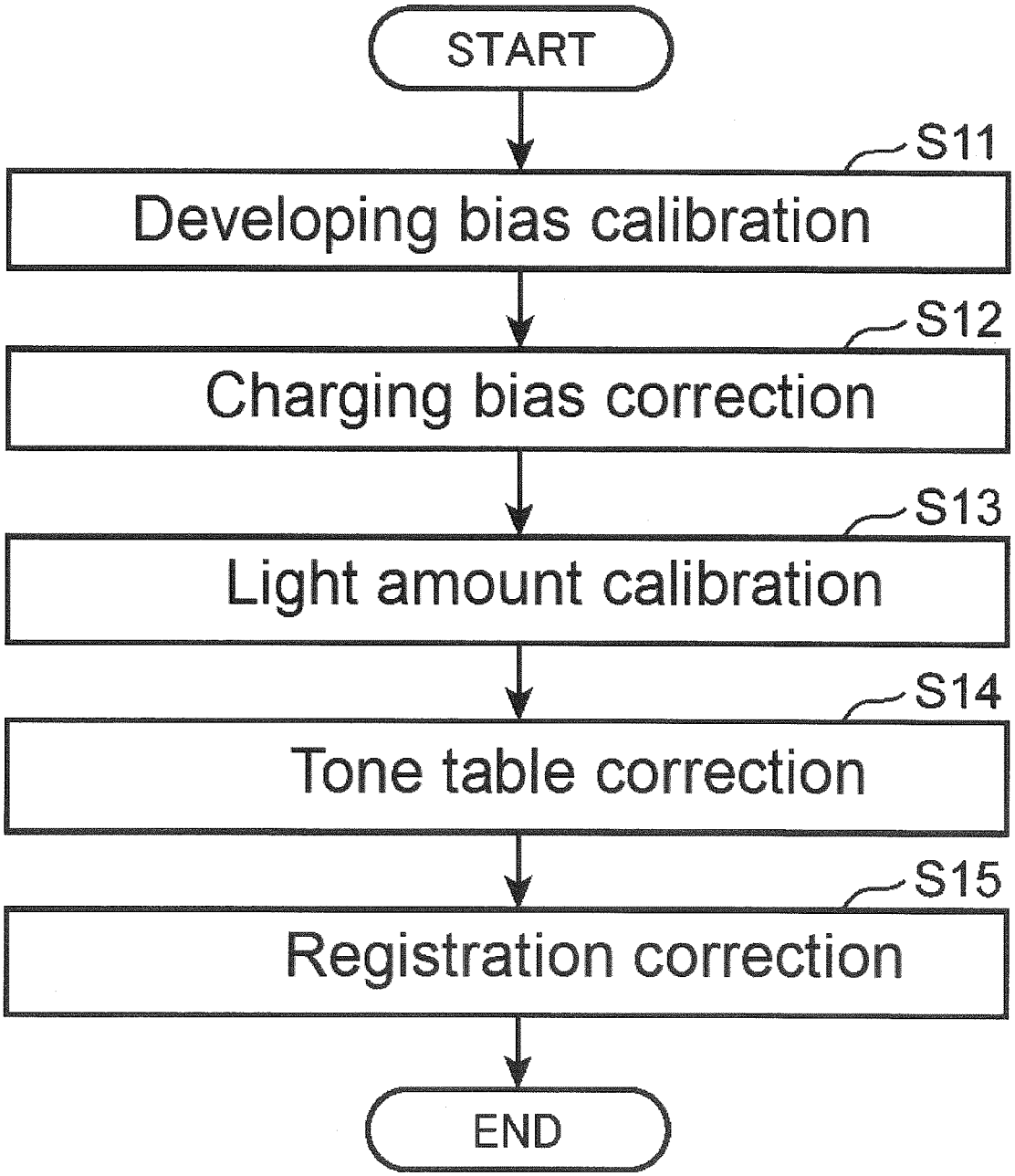
FIG. 8 illustrates a calibration operation according to the embodiment of the disclosure.

The above-described execution timing of the charging bias adjusting operation may be almost identical to a timing of the calibration operation (adjustments of developability, an amount of exposure, and color-shift correction) performed by the image forming apparatus 10. In view of this, the image condition adjusting unit 53 may perform the charging bias adjusting operation simultaneous with the execution of the calibration operation. FIG. 8 illustrates the calibration operation according to the embodiments. As one example, when the unused image forming apparatus 10 is left since the night on the previous day and a power supply of the image forming apparatus 10 is turned on in the morning of the next day, the image condition adjusting unit 53 performs the calibration operation in FIG. 8. The image condition adjusting unit 53 performs a developing bias calibration (Step S11). This calibration adjusts the value of the DC bias of the developing bias, the waveform of the AC bias, and a similar factor according to a detection result of the temperature and humidity by the environmental sensor 64. Next, the image condition adjusting unit 53 performs the charging bias adjusting operation (the correction of charging bias) according to the embodiment (Step S12). Afterwards, the image condition adjusting unit 53 performs a light amount calibration of the exposure apparatus 22 (Step S13). Here, an amount of laser light of the exposure apparatus 22 is adjusted to obtain an appropriate print density for a halftone image. Afterwards, the image condition adjusting unit 53 performs a tone table correction (a print density tone adjustment calibration) (Step S14). Here, continuous tone print densities from a low print density area to a high print density area are adjusted. Afterwards, the image condition adjusting unit 53 performs a registration correction (Step S15). This adjusts a color-shift correction registration of a full-color image or a similar defect.

Thus, in this embodiment, the image condition adjusting unit 53 performs the charging bias adjusting operation (Step S12), and then the calibration operation (Step S13), which adjusts the print density tone of the toner image, is performed. Accordingly, the print density tone of the toner image is adjusted with the surface potential V0 of the photoreceptor drum 20 stably held. This ensures obtaining a stable image quality in the subsequent image forming operation.

Correction of Charging Bias Vref

The following describes a third embodiment of the disclosure. Compared with the above-described first and second embodiments, this embodiment differs in predictive control of the charging bias Vref performed beforehand prior to the formation of the band latent image in FIG. 4 (Step S1). Therefore, the following describes only this difference and omits descriptions on other common control aspects. Vref, which is used in the charging bias adjusting operation, is preferably a value that can accurately reproduce the target surface potential V0 for the photoreceptor drum 20. However, the charging bias Vref required to reproduce the identical target electric potential V0 is likely to largely change due to the environment (the temperature and humidity), a period of using the photoreceptor drum 20 (a degree of deterioration of a surface layer of the photoreceptor drum 20), or a similar factor. In view of this, in this embodiment, the image condition adjusting unit 53 corrects the value of the charging bias Vref (the first tentative charging bias) according to a predetermined correction condition prior to the charging bias adjusting operation (see FIG. 4).

Table 1 shows an amount of correction of the charging bias Vref corrected by the image condition adjusting unit 53 when the temperature and the humidity detected by the environmental sensor 64 change. The storage unit 54 preliminary stores this amount of correction. As one example, with the detected temperature and humidity at 18 degrees and 30% RH, a value found by adding 76 V to a predetermined reference value is set as the charging bias Vref, and the charging bias adjusting operation is started. With this correction, even if the properties of the photoreceptor drum 20 and the charging apparatus 21 change according to the temperature and humidity, the adjusting operation is performed in the electric potential area close to the actual target electric potential V0. Therefore, the charging bias adjusting operation is quickly and accurately achieved.

TABLE 1

| | | Temperature (T ° C.) | | | | | | | | | | | | | | |
|---|---|---|---|---|---|---|---|---|---|---|---|---|---|---|---|---|
| | | 0 | 5 | 12 | 14 | 16 | 18 | 20 | 22 | 23 | 24 | 26 | 28 | 30 | 32 | 40 |
| Humidity (H %) | 15% | 346 | 274 | 180 | 161 | 139 | 118 | 114 | 111 | 109 | 100 | 80 | 61 | 48 | 31 | −24 |
| | 20% | 337 | 265 | 173 | 150 | 127 | 104 | 98 | 93 | 90 | 81 | 62 | 44 | 31 | 16 | −31 |
| | 25% | 328 | 257 | 166 | 139 | 115 | 90 | 82 | 74 | 71 | 62 | 44 | 27 | 15 | 1 | −37 |
| | 30% | 319 | 248 | 159 | 129 | 102 | 76 | 66 | 56 | 51 | 43 | 26 | 10 | −2 | −14 | −43 |
| | 35% | 313 | 242 | 152 | 122 | 94 | 66 | 55 | 44 | 39 | 31 | 15 | 0 | −10 | −20 | −44 |
| | 40% | 307 | 236 | 146 | 115 | 86 | 57 | 44 | 32 | 26 | 18 | 4 | −10 | −18 | −26 | −45 |
| | 45% | 301 | 230 | 139 | 108 | 77 | 47 | 34 | 20 | 13 | 6 | −7 | −20 | −26 | −32 | −46 |
| | 50% | 295 | 224 | 132 | 100 | 69 | 38 | 23 | 8 | 0 | −6 | −18 | −31 | −35 | −39 | −47 |
| | 55% | 291 | 220 | 128 | 96 | 64 | 32 | 18 | 4 | −3 | −9 | −20 | −31 | −35 | −39 | −47 |
| | 60% | 287 | 216 | 124 | 91 | 58 | 26 | 13 | 0 | −6 | −11 | −21 | −32 | −35 | −39 | −47 |
| | 65% | 283 | 212 | 120 | 86 | 53 | 19 | 8 | −3 | −9 | −14 | −23 | −32 | −35 | −40 | −47 |
| | 70% | 279 | 208 | 116 | 82 | 47 | 13 | 3 | −7 | −12 | −16 | −24 | −33 | −36 | −40 | −47 |
| | 75% | 275 | 204 | 112 | 77 | 42 | 7 | −2 | −10 | −15 | −19 | −26 | −33 | −36 | −41 | −47 |
| | 80% | 271 | 200 | 108 | 72 | 37 | 1 | −7 | −14 | −18 | −21 | −28 | −34 | −36 | −41 | −47 |

Table 2 shows an amount of correction of the charging bias Vref corrected by the image condition adjusting unit 53 according to a driving period of the photoreceptor drum 20 detected by the count unit 55. The storage unit 54 preliminary stores this amount of correction. As one example, with the detected driving period of the photoreceptor drum 20 of 50 hours, a value found by adding 50 V to a predetermined reference value is set as the charging bias Vref and the charging bias adjusting operation is started. In this case, even if the charging characteristic of the photoreceptor drum 20 changes according to the driving period of the photoreceptor drum 20, the charging bias adjusting operation is quickly and accurately achieved. In another modified embodiment, the count unit 55 may count an accumulated application period of the charging bias by the charging apparatus 21. It is only necessary that the storage unit 54 preliminary stores correction values shown in Table 2 according to the accumulated application period of the charging bias. In this case as well, even if the charging characteristic of the charging roller 21A changes according to the accumulated application period of the charging bias, the charging bias adjusting operation is quickly and accurately achieved. With the above-described respective amounts of correction in combination with one another, the charging bias Vref may be adjusted by the temperature and humidity inside and outside the machine of the image forming apparatus 10, the driving period of the photoreceptor drum 20, and a similar factor. The charging bias Vref may be adjusted according to other correction conditions. The above-described respective correction values may be stored not as a table but as a predetermined correction formula.

TABLE 2

| | Photoreceptor driving time [Time] | | | | | | | | |
|---|---|---|---|---|---|---|---|---|---|
| | 0 | 10 | 20 | 30 | 40 | 50 | 60 | 500 | 1000 |
| Amount of Vref correction [V] | 0 | 10 | 20 | 30 | 40 | 50 | 60 | 60 | 50 |

After the above-described charging bias Vref is corrected, the charging bias adjusting operation similar to the above-described first or second embodiment is performed. In this respect, at Step S3 in FIG. 4, if an error occurs in the print density detection of the toner image due to some sort of unexpected cause, the image condition adjusting unit 53 possibly adjusts the charging bias to obtain the target electric potential V0 to be excessively high. In this case, the photosensitive layer on the surface of the photoreceptor drum 20 possibly causes a dielectric breakdown. To solve such problem, in this embodiment, the image condition adjusting unit 53 first derives the value of the charging bias where the print density of the toner image becomes zero at Step S4 in FIG. 4. When the derived charging bias is greater than the charging bias Vref preliminary corrected with the above-described Table 1 or a similar material, the image condition adjusting unit 53 decides the charging bias equal to or less than the corrected charging bias Vref as the charging bias corresponding to the target electric potential V0. That is, the decided charging bias is adjusted so as not to exceed the corrected charging bias Vref. Consequently, this prevents the excessive bias from being applied to the photoreceptor drum 20 after the charging bias adjusting operation and prevents the photosensitive layer (the surface layer) of the photoreceptor drum 20 from being damaged.

The image forming apparatus 10 according to the embodiments of the disclosure is described above in detail; however, the disclosure is not limited to this. The disclosure can employ, for example, the following modified embodiments.

(1) The above-described respective embodiments describe the aspect that the toner is charged to a positive polarity; however, the disclosure is not limited to this. When the toner is charged to a negative polarity, the similar charging bias adjusting control is executable with polarities of the above-described respective biases inverted.

(2) The above-described embodiments describe the aspect that the image forming apparatus 10 is the full-color image forming apparatus; however, the disclosure is not limited to this. The image forming apparatus 10 may be a monochrome printer or a similar printer that forms a single color image.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body;

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

a developing device that includes a developing roller disposed opposed to the photoreceptor drum, the developing device supplying the photoreceptor drum with toner to develop the electrostatic latent image into a toner image;

a transfer apparatus that transfers the toner image from the photoreceptor drum to a sheet or an intermediate transfer belt;

a charging bias applying unit that applies a predetermined charging bias to the charging apparatus;

a developing bias applying unit that applies a predetermined developing bias to the developing roller;

a bias adjusting unit that performs a charging bias adjusting operation, the charging bias adjusting operation adjusting an electric potential at the background portion in the electrostatic latent image on the photoreceptor drum to a predetermined target electric potential; and a print density measurement unit that measures a print density of the toner image, wherein in the charging bias adjusting operation, the bias adjusting unit:

controls the charging bias applying unit to form a plurality of electric potential areas of electric potentials with different magnitudes, the electric potential areas being formed on the circumference surface of the photoreceptor drum along the rotation direction;

controls the developing bias applying unit to apply the predetermined developing bias corresponding to the target electric potential to the developing roller, so as to form a plurality of toner images by electric potential differences between the developing bias and the plurality of electric potential areas;

decides a value of the charging bias corresponding to the target electric potential from measurement results of the print densities of the plurality of toner images measured by the print density measurement unit;

controls the developing bias applying unit to apply the developing bias with a value identical to the target electric potential to the developing roller;

derives a value of the charging bias at which the print density of the toner image becomes zero from a relationship between the measurement results of the print densities of the plurality of toner images and the plurality of charging biases corresponding to the plurality of electric potential areas; and decides the derived charging bias as the charging bias corresponding to the target electric potential.

2. The image forming apparatus according to claim 1, wherein in the charging bias adjusting operation, the bias adjusting unit:

causes the charging bias applying unit to apply a first tentative charging bias preset corresponding to the target electric potential; and applies a plurality of charging biases such that absolute values of the plurality of charging biases decrease in order from the first tentative charging bias so as to form the plurality of electric potential areas.

3. The image forming apparatus according to claim 2, wherein in the charging bias adjusting operation, the bias adjusting unit:

applies a first charging bias whose absolute value is smaller than the first tentative charging bias; and subsequently applies a second charging bias whose absolute value is smaller than the first charging bias so as to form the plurality of electric potential areas, wherein an electric potential difference between the first tentative charging bias and the first charging bias is greater than an electric potential difference between the first charging bias and the second charging bias.

4. The image forming apparatus according to claim 2, wherein prior to the charging bias adjusting operation, the bias adjusting unit corrects a value of the first tentative charging bias according to a predetermined correction condition.

5. The image forming apparatus according to claim 4, further comprising:

an environment detector that detects a surrounding temperature or humidity, wherein the bias adjusting unit corrects the value of the first tentative charging bias according to the temperature or the humidity detected by the environment detector as the correction condition.

6. The image forming apparatus according to claim 4, further comprising:

a count unit that counts a count of accumulated rotations of the photoreceptor drum or an accumulated application period of the charging bias by the charging apparatus, wherein the bias adjusting unit corrects the value of the first tentative charging bias according to a count result by the count unit as the correction condition.

7. The image forming apparatus according to claim 1, further comprising:

an environment detector that detects a surrounding temperature or humidity, wherein when the temperature or the humidity detected by the environment detector exceeds a preset threshold, the bias adjusting unit performs the charging bias adjusting operation.

8. The image forming apparatus according to claim 1, further comprising:

a count unit that counts a count of printed sheets to which the toner image is transferred, wherein when the count of printed sheets printed within a predetermined period exceeds a preset threshold, the bias adjusting unit performs the charging bias adjusting operation.

9. The image forming apparatus according to claim 1, further comprising:

a count unit that counts a printing interval period between sheets to which the toner image is transferred, wherein when the printing interval period exceeds a preset threshold, the bias adjusting unit performs the charging bias adjusting operation.

10. The image forming apparatus according to claim 1, wherein the bias adjusting unit performs the charging bias adjusting operation, and subsequently the bias adjusting unit performs a calibration operation, the calibration operation adjusting a print density tone of the toner image.

11. An image forming apparatus comprising:

an apparatus main body:

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

a developing device that includes a developing roller disposed opposed to the photoreceptor drum, the developing device supplying the photoreceptor drum with toner to develop the electrostatic latent image into a toner image;

a transfer apparatus that transfers the toner image from the photoreceptor drum to a sheet or an intermediate transfer belt;

a charging bias applying unit that applies a predetermined charging bias to the charging apparatus;

a developing bias applying unit that applies a predetermined developing bias to the developing roller;

a bias adjusting unit that performs a charging bias adjusting operation, the charging bias adjusting operation adjusting an electric potential at the background portion in the electrostatic latent image on the photoreceptor drum to a predetermined target electric potential; and a print density measurement unit that measures a print density of the toner image, wherein in the charging bias adjusting operation, the bias adjusting unit:

controls the charging bias applying unit to form a plurality of electric potential areas of electric potentials with different magnitudes, the electric potential areas being formed on the circumference surface of the photoreceptor drum along the rotation direction;

controls the developing bias applying unit to apply the predetermined developing bias corresponding to the target electric potential to the developing roller, so as to form a plurality of toner images by electric potential differences between the developing bias and the plurality of electric potential areas;

decides a value of the charging bias corresponding to the target electric potential from measurement results of the print densities of the plurality of toner images measured by the print density measurement unit;

controls the developing bias applying unit to apply the developing bias with a value smaller than the target electric potential by a preset first differential electrical potential to the developing roller;

derives a value of a charging bias at which the print density of the toner image becomes zero from a relationship between the measurement results of the print densities of the plurality of toner images and the plurality of charging biases corresponding to the plurality of electric potential areas; and decides a value found by adding the first differential electrical potential to the derived charging bias as the charging bias corresponding to the target electric potential.

12. The image forming apparatus according to claim 11, wherein in the charging bias adjusting operation, the bias adjusting unit:

causes the charging bias applying unit to apply a second tentative charging bias, the second tentative charging bias being smaller than a first tentative charging bias preset corresponding to the target electric potential by a preset second differential electrical potential; and applies a plurality of charging biases such that absolute values of the plurality of charging biases decrease in order from the second tentative charging bias so as to form the plurality of electric potential areas.

13. The image forming apparatus according to claim 12, wherein the first differential electrical potential and the second differential electrical potential have an identical value.

14. The image forming apparatus according to claim 13, wherein in the charging bias adjusting operation, the bias adjusting unit:

applies a third charging bias whose absolute value is smaller than an absolute value of the second tentative charging bias; and subsequently applies a fourth charging bias whose absolute value is smaller than an absolute value of the third charging bias so as to form the plurality of electric potential areas, wherein an electric potential difference between the second tentative charging bias and the third charging bias is greater than an electric potential difference between the third charging bias and the fourth charging bias.

15. An image forming apparatus comprising:

an apparatus main body:

a photoreceptor drum that has a circumference surface on which an electrostatic latent image including a background portion and an image portion is formed, the photoreceptor drum being rotationally driven in a predetermined rotation direction;

a charging apparatus arranged in contact with or close to the circumference surface of the photoreceptor drum, the charging apparatus charging the circumference surface at a predetermined electric potential;

a developing device that includes a developing roller disposed opposed to the photoreceptor drum, the developing device supplying the photoreceptor drum with toner to develop the electrostatic latent image into a toner image;

a transfer apparatus that transfers the toner image from the photoreceptor drum to a sheet or an intermediate transfer belt;

a charging bias applying unit that applies a predetermined charging bias to the charging apparatus;

a developing bias applying unit that applies a predetermined developing bias to the developing roller;

a bias adjusting unit that performs a charging bias adjusting operation, the charging bias adjusting operation adjusting an electric potential at the background portion in the electrostatic latent image on the photoreceptor drum to a predetermined target electric potential; and a print density measurement unit that measures a print density of the toner image, wherein in the charging bias adjusting operation, the bias adjusting unit:

controls the charging bias applying unit to form a plurality of electric potential areas of electric potentials with different magnitudes, the electric potential areas being formed on the circumference surface of the photoreceptor drum along the rotation direction;

controls the developing bias applying unit to apply the predetermined developing bias corresponding to the target electric potential to the developing roller, so as to form a plurality of toner images by electric potential differences between the developing bias and the plurality of electric potential areas; and decides a value of the charging bias corresponding to the target electric potential from measurement results of the print densities of the plurality of toner images measured by the print density measurement unit, and wherein the bias adjusting unit:

prior to the charging bias adjusting operation, corrects a first tentative charging bias preset corresponding to the target electric potential according to a predetermined correction condition;

in the charging bias adjusting operation, controls the developing bias applying unit to apply the developing bias with a value identical to the target electric potential to the developing roller;

causes the charging bias applying unit to apply the corrected first tentative charging bias and applies a plurality of charging biases such that absolute values of the plurality of charging biases decrease in order from the corrected first tentative charging bias so as to form the plurality of electric potential areas;

derives a value of a charging bias at which the print density of the toner image becomes zero from a relationship between the measurement results of the print densities of the plurality of toner images and the plurality of charging biases corresponding to the plurality of electric potential areas; and when the derived charging bias is greater than the first tentative charging bias after the correction, decides a charging bias equal to or less than the first tentative charging bias after the correction as the charging bias corresponding to the target electric potential.

* * * * *